US010830258B2

(12) United States Patent
Hahn et al.

(10) Patent No.: US 10,830,258 B2
(45) Date of Patent: Nov. 10, 2020

(54) DEVICE FOR THE DIRECT RECOVERY OF HYDRAULIC ENERGY BY MEANS OF A SINGLE-ACTING HYDRAULIC CYLINDER

(71) Applicant: Liebherr-Mining Equipment Colmar SAS, Colmar (FR)

(72) Inventors: Philipp Hahn, Turckheim (FR); Volker Gliniorz, Breisach am Rhein (DE); Guillaume Bonnetot, Zimmersheim (FR)

(73) Assignee: LIEBHERR-MINING EQUIPMENT COLMAR SAS, Colmar (FR)

( * ) Notice: Subject to any disclaimer, the term of this patent is extended or adjusted under 35 U.S.C. 154(b) by 0 days.

(21) Appl. No.: 15/622,679

(22) Filed: Jun. 14, 2017

(65) Prior Publication Data

US 2017/0363115 A1 Dec. 21, 2017

(30) Foreign Application Priority Data

Jun. 15, 2016 (DE) ..... 10 2016 007 266

(51) Int. Cl.

| | |
|---|---|
| ***F15B 13/02*** | (2006.01) |
| ***F15B 1/02*** | (2006.01) |
| ***F15B 1/04*** | (2006.01) |
| ***F15B 11/024*** | (2006.01) |
| ***F15B 15/18*** | (2006.01) |
| ***F15B 21/14*** | (2006.01) |

(52) U.S. Cl.

CPC ..... *F15B 13/021* (2013.01); *F15B 1/024* (2013.01); *F15B 1/04* (2013.01); *F15B 11/024* (2013.01); *F15B 13/027* (2013.01); *F15B 15/18* (2013.01); *F15B 21/14* (2013.01); *F15B 2201/31* (2013.01); *F15B 2201/405* (2013.01); *F15B 2211/3056* (2013.01); *F15B 2211/30505* (2013.01)

(58) Field of Classification Search

CPC . E02F 9/2217; B66F 9/22; F15B 2211/20546; F15B 2211/88; F15B 13/021; F15B 11/024; F15B 1/04; F15B 13/027; F15B 15/18; F15B 21/14

See application file for complete search history.

(56) References Cited

U.S. PATENT DOCUMENTS

| | | | | |
|---|---|---|---|---|
| 6,502,393 | B1 * | 1/2003 | Stephenson | F15B 11/006 60/414 |
| 9,057,389 | B2 * | 6/2015 | Opdenbosch | E02F 9/2217 |
| 9,809,957 | B2 * | 11/2017 | Rosth | E02F 9/2217 |

(Continued)

FOREIGN PATENT DOCUMENTS

DE 60120061 T2 11/2006

*Primary Examiner* — Abiy Teka
(74) *Attorney, Agent, or Firm* — McCoy Russell LLP

(57) ABSTRACT

The invention concerns a device for the direct recovery of hydraulic energy in a machine, comprising at least one single-acting storage cylinder-piston device with a storage cylinder, a storage cylinder-piston and a storage cylinder chamber, with at least one differential cylinder-piston device with a differential cylinder comprising a separate rod side and base side, and with at least one hydraulic accumulator, which may be connected to the storage cylinder-piston device and/or the differential cylinder-piston device, wherein the potential energy of the storage cylinder-piston device, which retracts under a compressive load, may be at least partially stored in the hydraulic accumulator.

17 Claims, 1 Drawing Sheet

(56) References Cited

U.S. PATENT DOCUMENTS

2013/0318955 A1* 12/2013 Zhang ..... E02F 9/2217
60/413
2013/0340418 A1 12/2013 Wen et al.

* cited by examiner

DEVICE FOR THE DIRECT RECOVERY OF HYDRAULIC ENERGY BY MEANS OF A SINGLE-ACTING HYDRAULIC CYLINDER

CROSS-REFERENCE TO RELATED APPLICATION

The present application claims priority to German Patent Application No. 10 2016 007 266.0, entitled "DEVICE FOR THE DIRECT RECOVERY OF HYDRAULIC ENERGY BY MEANS OF A SINGLE-ACTING HYDRAULIC CYLINDER," filed on Jun. 15, 2016, the entire contents of which is hereby incorporated by reference in its entirety for all purposes.

TECHNICAL FIELD

The invention concerns a device for the direct recovery of hydraulic energy in a machine, comprising at least one single-acting storage cylinder-piston device with a storage cylinder, a storage cylinder-piston and a storage cylinder chamber, with at least one differential cylinder-piston device with a differential cylinder comprising a separate rod side and base side, and with at least one hydraulic accumulator, which may be connected to the storage cylinder-piston device and/or the differential cylinder-piston device, wherein the potential energy of the storage cylinder-piston device, which retracts under a compressive load, may be at least partially stored in the hydraulic accumulator.

BACKGROUND AND SUMMARY

In hydraulic cylinder circuits known from the prior art used in mobile machines, the retracting of hydraulic cylinders under a compressive load, such as the non-pressurised lowering of a lift or a lifting arm, is achieved through throttle control. In this process the potential energy, which is defined by the load applied to the cylinder, is converted into heat through the throttling of the pressurised flow. The present potential energy is disadvantageously destroyed through this process. Due to the conversion into heat it is, moreover, necessary to disadvantageously expend additional energy for cooling inside the machine.

A commonly used design of hydraulic cylinders in mobile machines is the differential cylinder. If said cylinder is retracted by way of throttle control under compressive load it must be ensured that the rod side cylinder chamber is refilled. This may be achieved on the one hand by applying a corresponding supply flow rate by means of the operating pumps, on the other hand it may be achieved by returning the throttled flow from the base side into the rod side to achieve a corresponding refilling of the rod side cylinder chamber. The result of returning the throttled flow is that it causes a division of the flow according to the surface ratio of the hydraulic cylinders or, respectively, according to the surface ratio of rod side and base side of the hydraulic cylinder or cylinders. In this instance part of the flow is led into the rod side chambers of the cylinders, whereas the other part is diverted into the tank.

If it is intended to store the potential energy that is present during the lowering of the lifting cylinder, it is of interest to store as much as possible of the available energy. In the field of hydraulics this corresponds to as large as possible oil volumes under the highest possible pressure. The hydraulic circuits known from the prior art, which realise the return of part of the flow from the base side into the rod side chambers of the hydraulic cylinders, reduce the flow that may be available for storage.

Currently there are a number of different solutions known to store the potential energy, for example during lowering of the boom of mobile hydraulic machines. Devices are known in which one of two cylinders is used to store energy. In this instance a positive displacement machine is used in a closed circuit to refill the rod side chambers of both cylinders with the return flow volume of the second cylinder. A disadvantage of such devices is that there is no exchange of oil at the base side of the hydraulic cylinder, which is connected to the accumulator. The oil volume is only moved between the hydraulic accumulator and the base side of the cylinder.

Devices are also known in which a hydraulic pump is used during the retraction of the cylinders so as to achieve the refilling of the rod side chambers. Refilling by means of expending hydraulic energy is not in accordance with an energy efficient control of the hydraulic loads.

Also known is the accumulation of the potential energy of the boom by a gas-filled cylinder. However, a corresponding additional integration of a gas cylinder into the machine is necessary, which results in high integration expenses. Moreover, the accumulator volume of the gas storage cylinder must be designed for the entire lifting stroke of the drive, even if the entire lifting stroke is not used in normal operation.

The hydraulic circuits known from the prior art thus have the following three disadvantages:

1. The potential energy of the lifting/lowering process is destroyed by the throttling process and cannot be used for other processes.
2. The potential energy of the lifting/lowering process is introduced into the hydraulic system in form of heat energy and must subsequently be dissipated through corresponding cooling facilities. These processes also consume energy.
3. The splitting of the base side flow during lowering of the lifting cylinders causes a reduction of the possible potential energy that could be stored.

It is therefore the object of the invention to store the potential energy that is defined by the compressive load onto the hydraulic cylinders and at the same time reduce the oil volume necessary for refilling the rod side chambers of the hydraulic cylinders. This maximises the amount of storable potential energy, which may be utilised for extending the hydraulic cylinders under compressive load. Moreover, the expended amount of cooling energy may be reduced since a lower amount of heat losses have to be dissipated by the cooling system of the machine. On this basis the entire operation of the hydraulic machine may be made more energy efficient.

This object is met, according to the invention, by a device with the characteristics of claim 1. Advantageous embodiments are subject of the dependent claims.

According to this a device is provided for the direct recovery of hydraulic energy in a machine, comprising at least one single-acting storage cylinder-piston device with a storage cylinder, a storage cylinder-piston and a storage cylinder chamber, with at least one differential cylinder-piston device with a differential cylinder comprising a separate rod side and base side, and with at least one hydraulic accumulator, which may be connected to the storage cylinder-piston device and/or the differential cylinder-piston device, wherein the potential energy of the storage cylinder-piston device, which retracts under a compressive load, may be at least partially stored in the hydraulic accumulator.

According to the invention the device may be designed such that only the single-acting storage cylinder or hydraulic cylinder respectively is used for storing energy.

In a preferred embodiment it is feasible that the ratio between the retracting and extending movement of the storage cylinder-piston device and the differential cylinder-piston device to each other is predetermined in a fixed ratio to each other by their mechanical attachment.

Said mechanical attachment simplifies a simultaneous use of both cylinder-piston devices, in which only one of the cylinder-piston devices is used for the recovery of hydraulic energy on retraction of the cylinder-piston device.

In a further preferred embodiment it is feasible that the storage cylinder-piston device and the differential cylinder-piston device are arranged for parallel operation to each other. Parallel operation in this instance may mean that both cylinder-piston devices are arranged for simultaneous retraction and extension in the same direction, wherein retraction and extension may take place in the same direction. This makes it possible to advantageously provide both cylinder-piston devices on a single pivot on a machine, for example.

In a further preferred embodiment it is feasible that the device comprises more than one differential cylinder-piston device, wherein the differential cylinder-piston devices are coupled to each other through their base side connections and rod side connections. It is thus possible to utilise the device for energy recovery also on a plurality of, for example, pivots of a machine. In this instance it is possible to couple two, three or more differential cylinder-piston devices to each other.

In a further preferred embodiment it is feasible that at least one operating pump is provided to drive the storage cylinder-piston device and the differential cylinder-piston device, and/or that at least one slide valve is provided to control the storage cylinder-piston device and the differential cylinder-piston device. Moreover, in a further preferred embodiment it may be arranged that a differential cylinder brake valve is provided for shutting off the base side of the differential cylinder-piston device, and/or that a storage valve is provided for shutting off the hydraulic accumulator, and/or that a storage cylinder brake valve is provided for shutting off the storage cylinder chamber of the storage cylinder from a tank, and/or that a connecting valve is provided for connecting the base end of the differential cylinder-piston device to the storage cylinder chamber of the storage cylinder-piston device. Advantages of the stated characteristics are described in the description of the FIGURES.

The invention is, moreover, aimed at a machine, in particular a wheel loader, a hydraulic excavator or a crane, comprising a device for the direct recovery of hydraulic energy according to one of the claims 1 to 8. Particularly preferred is a provision wherein the machine is designed such that, in the instance of failure of the device for the direct recovery of hydraulic energy, the machine remains operational without the loss of further functions.

According to this, the device for the recovery of hydraulic energy may be provided as just an additional device on the machine, wherein the machine retains all necessary actuators for the operation of the machine, or is able to operate them respectively, even without the device according to the invention. Thus the device according to the invention may advantageously be retrofitted on machines known per se, wherein the functionality of the machine is independent from the device.

DETAILED DESCRIPTION

Figure 1:
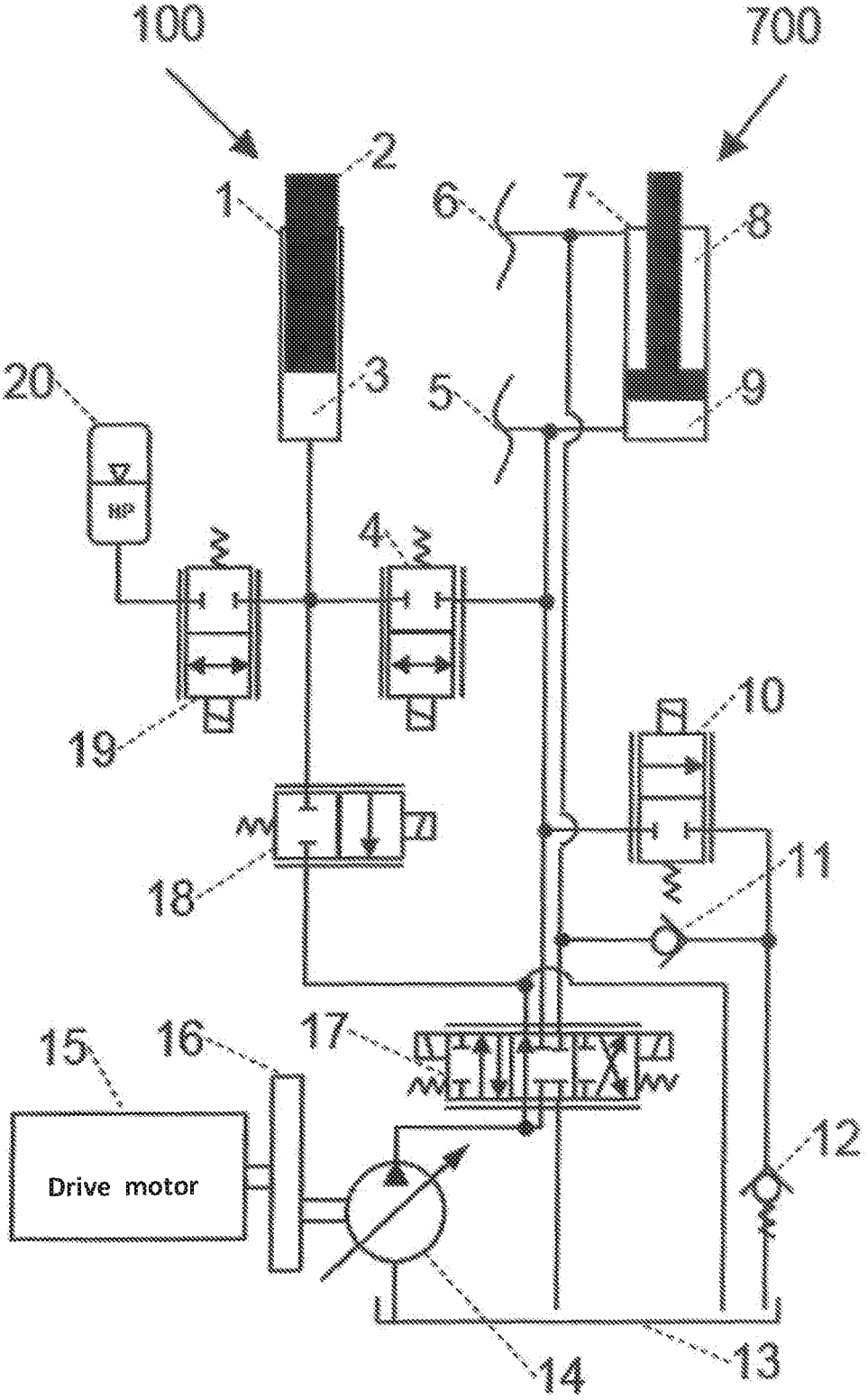
FIG. 1 depicts an embodiment of a device for the direct recovery of hydraulic energy.

When taking the machine in operation, the corresponding preload pressure may be present in the high-pressure accumulator 20. If the storage process is to be started, an external force has to be present on the differential cylinder 7 and on the storage cylinder 1, which leads to a retraction. Differential cylinder 7 and storage cylinder 1 are part of the respective differential cylinder-piston device 700 and the storage cylinder-piston device 100. Where this description refers to cylinders or differential cylinders, those skilled in the art know that, depending on context, this may also mean the corresponding cylinder-piston device.

As the respective pistons retract, pressure builds up at the base side 9 of the differential cylinder 7 and in the cylinder chamber 3 of the storage cylinder 1, which defines the present potential energy. Said potential energy is to be absorbed by the hydraulic accumulator 20. At the start of the lowering process the differential cylinder brake valve 10 of the differential cylinder 7 and the storage valve 19 of the storage cylinder 1 are opened. Through the differential cylinder brake valve 10 of the differential cylinder 7 a portion of the flow passes from the base side 9 of the differential cylinder 7 at a preload pressure, which is determined by the preload valve 12, through the non-return valve 11 to the rod side 8 of the differential cylinder 7. This prevents a lack of oil volume at the rod side 8 of the differential cylinder 7 during the retraction movement. The flow that is not absorbed by the rod side 8 of the differential cylinder 7 from the base side 9 of the differential cylinder 7 reaches the tank 13 via the preload valve 12. The oil volume displaced through the retracting movement of the storage cylinder piston 2 of the storage cylinder 1 from the storage cylinder chamber 3 of the storage cylinder 1 flows through the storage valve 19 into the hydraulic accumulator 20. Due to the volume absorption of the hydraulic accumulator 20 from the storage cylinder chamber 3 of the storage cylinder 1, the pressure in hydraulic accumulator 20 rises. Through proportional control of the differential cylinder brake valve 10 of the differential cylinder 7 and the storage valve 19, the retracting speed of the drive, consisting of differential cylinder 7 and storage cylinder 1, may be adjusted.

If the retracting movement of the differential cylinder 7 and storage cylinder 1 is to be stopped, the differential cylinder brake valve 10 of the differential cylinder 7 and the storage valve 19 will be closed. The hydraulic accumulator 20 now contains the pressurised oil volume, which was displaced during the retracting movement of the storage cylinder 1 by the storage cylinder piston 2 from the storage cylinder chamber 3 of the storage cylinder 1.

For the reutilisation of the hydraulic energy from the hydraulic accumulator 20 in an extension movement of storage cylinder 1 and differential cylinder 7, a connection is established by way of the storage valve 19 between hydraulic accumulator 20 and storage cylinder chamber 3 of storage cylinder 1. The operating pump 14, which is driven via the transfer gearbox 16 by drive motor 15, generates a flow which passes via a corresponding control system of slide valve 17 into the base side 9 of differential cylinder 7. The flow exiting from the rod side 8 of differential cylinder 7 is fed back into the tank 13 via the slide valve 17. Depending upon the hydraulic energy available in hydraulic accumulator 20, only the corresponding difference necessary for the extension of the differential cylinder 7 and the storage cylinder 1 has to be generated by the operating pump 14.

Depending on the size of the hydraulic accumulator 20, storage of the potential energy is possible either from the entire stroke or only part of the stroke of storage cylinder 1.

If the hydraulic accumulator 20 is designed for only part of the stroke of storage cylinder 1, and the retraction movement of storage cylinder 1 is to be greater than the design of the hydraulic accumulator 20 permits, a brake valve circuit is activated. Said circuit comprises a storage cylinder brake valve 18 of storage cylinder 1, which is connected to the storage cylinder chamber 3 of storage cylinder 1. The storage cylinder brake valve 18 may in this instance be designed as a 1-way valve. Through proportional control of the storage cylinder brake valve 18, the flow from the storage cylinder chamber 3 of the storage cylinder 1 is passed through storage cylinder brake valve 18 into tank 13. This allows for the retraction speed to be set. Control of the differential cylinder brake valve 10 of the differential cylinder 7 occurs parallel to the control of storage cylinder brake valve 18 of storage cylinder 1. Said control action also takes place in a desired retraction movement of storage cylinder 1 and differential cylinder 7 with a defective storage facility, wherein the hydraulic accumulator 20 and/or the storage valve 19 may be defective.

Depending on the charge state and design of the hydraulic accumulator 20 it may be necessary to implement an extension movement of the storage cylinder 1 and of the differential cylinder 7 with the aid of the operating pump 14. To achieve this, the storage valve 19 is kept closed and the connection valve 4 is opened. Through a corresponding control action of the slide valve 17 the flow is directed from the operating pump 14 to the base side 9 of the differential cylinder 7 and via the connection valve 4 into the storage cylinder chamber 3 of storage cylinder 1. The flow coming from the rod side 9 of the differential cylinder 7 is directed via the slide valve 17 back into the tank 13. Said control action may also take place in a desired extension movement of storage cylinder 1 and differential cylinder 7 with a defective storage facility, wherein the hydraulic accumulator 20 and/or the storage valve 19 may be defective.

If a retraction movement of the differential cylinder 7 is intended in the machine cycle, in which the flow of the operating pump 14 is to be directed to the rod side 8 of the differential cylinder 7 through a corresponding control action of the slide valve 17, the storage cylinder brake valve 18 of the storage cylinder 1 is kept open. The discharge flow from the storage cylinder chamber 3 of storage cylinder 1 is directed in this manner via storage cylinder brake valve 18 of the storage cylinder 1 into the tank 13. The discharged flow from the base side 9 of the differential cylinder 7 is directed back into tank 13 via the slide valve 17.

The invention comprises at least one differential cylinder 7 or at least one differential cylinder-piston device 700. Further differential cylinders 7 may be integrated into the system at the rod side connection 6 and the base side connection 5 of the differential cylinder 7. The circuit may be provided with at least one operating pump 14 and at least one slide valve 17. The hydraulic accumulator 20 may be chosen from all different kinds of hydraulic accumulators 20 with varying energy storage media such as, for example, nitrogen. Feasible are designs in form of bladder accumulators, piston accumulators, membrane accumulators and/or spring accumulators as well as different combinations of accumulator designs.

The depicted valves may be individual 2/2-way valves or they may be provided as a valve combination in form of a rod assembly. The control of said valves may be proportional or switched.

The invention is characterised by an arrangement of at least one hydraulic differential cylinder and at least one single-acting hydraulic cylinder. The single-acting hydraulic cylinder does not have a rod side chamber that would require refilling in a retracting movement. The ratio of the retraction and extension movement of the cylinders to each other is predetermined by their mechanical attachment in a forced ratio to each other. Said combination of hydraulic cylinders and their mechanical attachment will in the following be called a hydraulic linear drive.

The invention is characterised in that potential energy present during the retracting movement of the hydraulic linear drive under compressive load can be stored to a large degree with the aid of one or more hydraulic accumulator(s).

The invention is further characterised in that at least one single-acting hydraulic cylinder is used inside the hydraulic linear drive for the purpose of energy storage and energy release.

The invention is characterised in that the stored hydraulic energy may be fed directly back into the linear drive without energy conversion.

The invention is further characterised in that the hydraulic linear drive can be retracted and extended without activating the one or more hydraulic accumulator(s) and hydraulic valves for storing the potential energy. This is achieved inside the hydraulic circuit through a corresponding parallel connection of the hydraulic linear drive.

The invention is characterised in that the stored energy from the retraction process of the hydraulic linear drive can be released by the one or more single-acting cylinders during the extension process of the hydraulic linear drive. This is achieved through a corresponding connection of the one or more hydraulic accumulator(s) with corresponding valves.

The invention is further characterised in that the energy storage and release by means of the hydraulic linear drive is possible over the entire travel path or only over part of the possible travel path.

The invention is also characterised in that it can be integrated into the drive train of a machine without influencing the function of the drive train in such a way that the entire functionality of the machine is dependent on the invention. This means that the machine may be operated flawlessly even without the correct functioning of the invention.

The invention claimed is:

1. A device for direct recovery of hydraulic energy in a machine comprising:

a single-acting storage cylinder-piston device comprising a storage cylinder, a storage cylinder piston, and a storage cylinder chamber, wherein the storage cylinder includes only one hydraulic connection;

a differential cylinder-piston device comprising a differential cylinder with a separated rod side and a base side;

a hydraulic accumulator hydraulically connected to the single-acting storage cylinder-piston device and the differential cylinder-piston device, wherein only one valve is positioned in a flow pathway between the single-acting storage cylinder-piston device and the hydraulic accumulator; and an operating pump driven by a drive motor of the machine, where a further valve is positioned between the operating pump and the base side of the differential cylinder;

wherein a potential energy of the single-acting storage cylinder-piston device is stored at least partially in the hydraulic accumulator;

wherein the single-acting storage cylinder-piston device retracts under a compressive load; and wherein the device for direct recovery of hydraulic energy in the machine further comprises a tank, and wherein flow from the rod side of the differential cylinder is fed back into the tank via the further valve.

2. The device according to claim 1, wherein a ratio of a retracting and extending movement of the single-acting storage cylinder-piston device to the differential cylinder-piston device to each other is predetermined at a forced ratio through their mechanical attachment.

3. The device according to claim 1, wherein the storage cylinder-piston device and the differential cylinder-piston device are arranged to each other for parallel operation.

4. The device according to claim 1, wherein the operating pump is provided to operate at least one of the single-acting storage cylinder-piston device and the differential cylinder-piston device.

5. The device according to claim 1, further comprising a differential cylinder brake valve, wherein the differential cylinder brake valve shuts off the base side of the differential cylinder.

6. The device according to claim 5, wherein the only one valve positioned in the flow pathway between the single-acting storage cylinder-piston device and the hydraulic accumulator is a storage valve, and wherein the storage valve shuts off the hydraulic accumulator.

7. The device according to claim 1, further comprising a storage cylinder brake valve, wherein the storage cylinder brake valve shuts off the storage cylinder chamber of the single-acting storage cylinder-piston device from the tank.

8. The device according to claim 1, wherein a connection valve is provided to connect the base side of the differential cylinder to the storage cylinder chamber of the single-acting storage cylinder-piston device.

9. The machine according to claim 1, wherein the machine is configured such that it is able to operate when the device for direct recovery of hydraulic energy fails.

10. The device according to claim 1, wherein the further valve positioned between the operating pump and the base side of the differential cylinder is a slide valve, and wherein the slide valve controls at least one of the single-acting storage cylinder-piston device and the differential cylinder-piston device.

11. The device according to claim 1, wherein the only one valve positioned in the flow pathway between the single-acting storage cylinder-piston device and the hydraulic accumulator is a storage valve, and wherein the storage valve shuts off the hydraulic accumulator.

12. The device according to claim 1, wherein the rod side of the differential cylinder includes a rod side hydraulic connection and the base side of the differential cylinder includes a base side hydraulic connection.

13. The device according to claim 1, wherein the further valve positioned between the operating pump and the base side of the differential cylinder is the only valve positioned between the operating pump and the base side of the differential cylinder.

14. The device according to claim 1, wherein the single-acting storage cylinder-piston device and the differential cylinder-piston device are arranged for simultaneous retraction and extension in a same direction.

15. The device of claim 1, wherein the single-acting storage cylinder-piston device is directly coupled to a three-way junction.

16. The device of claim 1, wherein a connection valve is positioned between the single-acting storage cylinder-piston device and the further valve.

17. The device of claim 16, wherein a storage cylinder brake valve is positioned between the single-acting storage cylinder-piston device and the further valve.

* * * * *